US005333547A

United States Patent [19]

Pfisterer et al.

[11] Patent Number: 5,333,547

[45] Date of Patent: Aug. 2, 1994

[54] GRIPPER APPARATUS ON SHEET-PROCESSING MACHINES

[75] Inventors: Alexander Pfisterer, Eppelheim; Anton Rodi, Leimen, both of Fed. Rep. of Germany

[73] Assignee: Heidelberger Druckmaschinen AG, Heidelberg, Fed. Rep. of Germany

[21] Appl. No.: 3,106

[22] Filed: Jan. 11, 1993

[30] Foreign Application Priority Data

Jan. 10, 1992 [DE] Fed. Rep. of Germany ..... 4200406

[51] Int. Cl.[5] ..... B41F 1/30

[52] U.S. Cl. ..... 101/409; 101/232; 101/246; 271/82; 271/277

[58] Field of Search ..... 101/409, 410, 246, 415.1, 101/232, 240, 248; 270/58, 47, 60, 19; 271/82, 277

[56] References Cited

U.S. PATENT DOCUMENTS

| | | | |
|---|---|---|---|
| 3,768,406 | 10/1973 | Gutsche et al. | 101/409 |
| 4,033,260 | 7/1977 | Lein et al. | 101/232 |
| 4,127,265 | 11/1978 | Wirz et al. | 101/409 |
| 4,387,106 | 4/1983 | Loebach | 270/47 |
| 4,843,959 | 7/1989 | Rendell | 101/240 |
| 5,026,180 | 6/1991 | Tajima et al. | 101/409 |
| 5,029,525 | 7/1991 | Jeschke | 101/232 |
| 5,040,460 | 8/1991 | Stark et al. | 101/248 |
| 5,103,733 | 4/1992 | Drapatsky et al. | 101/232 |

FOREIGN PATENT DOCUMENTS 243661 11/1987 European Pat. Off. .

OTHER PUBLICATIONS

Publication: DER Elektronikar, "Incremental Annular Sensor for Determining Motions", (Hauser) pp. 40–43, May, 1984.

*Primary Examiner*—Eugene H. Eickholt

*Attorney, Agent, or Firm*—Herbert L. Lerner; Laurence A. Greenberg

[57] ABSTRACT

Gripper apparatus on a sheet-processing machine includes a pair of cooperative gripper members, a control device including a computer for controlling the pair of gripper members, at least one data transmitter connected to the computer for inputting data therein, and at least one mechanism for performing at least one function selected from a group thereof consisting of opening and closing the pair of gripper members in response to an output of the computer, the function-performing mechanism being operatable at predetermined positions of the sheet-processing machine.

15 Claims, 5 Drawing Sheets

GRIPPER APPARATUS ON SHEET-PROCESSING MACHINES

The invention relates to a gripper apparatus on sheet-processing machines.

Sheets are conventionally transported through a printing press by gripper bridges which are associated with impression cylinders of individual printing units of the printing press and with transfer drums located between the printing units. The gripper bridges are controlled by cam plates so that cyclical opening and closing movements, respectively, are executed in phase with the printing-press cycle at the instant of time at which sheet transfer and takeover, respectively, occur.

The closing and opening movements of the gripper bridges cause torque fluctuations which, especially at high press speeds, produce vibrations in the printing press and, consequently, mackling in the printed image. Moreover, freedom of movement of gripper members is restricted by the manner in which they are mechanically connected. Changes with respect to closing angle, closing force and closing end position are possible only after time-consuming readjustments, which must be performed with the printing press at rest. It is also impossible, for example, to limit the closing and opening movement to those gripper pairs which, depending upon the sheet size or format, are sufficient for transporting the sheet through the printing press.

It is an object of the invention, accordingly, to provide a gripper apparatus of the foregoing general type on sheet-processing machines such as printing presses, wherein individual gripper pairs or groups thereof are controlled independently of one another.

With the foregoing and other objects in view, there is provided, in accordance with the invention, a gripper apparatus on a sheet-processing machine, comprising a pair of cooperative gripper members, a control device including a computer for controlling the pair of gripper members, at least one data transmitter connected to the computer for inputting data therein, and means for performing at least one function selected from a group thereof consisting of opening and closing the pair of gripper members in response to an output of the computer, the function performing means being operatable at predetermined positions of the sheet-processing machine.

By individual control of gripper pairs and control in common or joint control of very small groups of the gripper pairs, respectively, torque fluctuations occurring in the printing press are reduced. A considerable advantage of the gripper apparatus according to the invention over the prior art is afforded, moreover, by providing a control device therein for controlling the opening and/or closing mechanism for the gripper pairs in accordance with the respective position of the paper sheet. Because an optimal position of the sheet in the gripper pairs is thereby attained, the transport of the sheet through the printing press becomes even more reliable.

In accordance with another feature of the invention, the data transmitter is an angle-of-rotation transmitter.

In accordance with an alternate feature of the invention, the data transmitter is a sensing device for detecting the position of a paper sheet.

There are thus two possible basic choices: either the transmitter is an angle-of-rotation transmitter, which determines the respective position of the impression and transfer cylinders, respectively, so that the control device operates the opening and/or closing mechanism of the gripper pairs at a desired angular position; or the transmitter is a paper sheet-position detection sensor, and the control device utilizes the position of the leading edge of the sheet or, alternatively, the trailing edge of the sheet, for operating the opening and/or closing mechanism at predetermined positions of the printing press. The use of a paper sheet-position detection sensor is particularly advantageous in that it provides automatic compensation for displacements of the sheet resulting from differences in paper quality.

The gripper apparatus according to the invention may have different types of construction.

Thus, in accordance with an added feature of the invention, the function-performing means comprise an electromagnet, which both actuates a closing as well as an opening mechanism electromagnetically. This embodiment offers the advantage that very high closing and opening speeds may be achieved without problem, a capability which is of particular importance for increasing printing-press speeds.

In accordance with one alternative construction of the invention, the function-performing means comprise an opening mechanism formed as a spring, and a closing mechanism formed as an electromagnet.

In accordance with another alternative construction of the invention, the function-performing means comprise an opening mechanism formed as an electromagnet, and a closing mechanism formed as a spring.

These alternative constructions ensure that even if disruptions should occur in the activation of one or more gripper apparatuses, the gripper pair or pairs, respectively, are opened so that the sheet can also be transported further through the printing press.

In accordance with yet an added feature of the invention, the motor has an output shaft, a sleeve secured to the output shaft and formed with an internal thread, and a carrier rod rigidly connected to the gripper member of the respective gripper pair and formed with an external thread engaging with the internal thread of the sleeve so that, depending upon the direction of rotation of the motor, the gripper pair is opened or closed.

In accordance with yet an additional feature of the invention, a guide sleeve guidingly engages the carrier rod, the guide sleeve being formed with a slot, and the carrier rod has a pin extending therefrom and engaging in the slot so as to secure the carrier rod against turning relative to the sleeve.

In accordance with an alternative feature of the invention, the motor has an output shaft, a spur gear carried by the output shaft, a toothed rack rigidly connected to the gripper member of the respective gripper pair, the spur gear meshingly engaging with the toothed rack so that the respective gripper pair opens and closes, respectively, in accordance with the direction of rotation of the motor.

In accordance with a further feature of the invention, the control device includes means for hydraulically controlling the mechanism for respectively opening and closing the gripper pair.

In accordance with an alternative feature of the invention, the control device includes means for pneumatically controlling the mechanism for respectively opening and closing the gripper pair.

Actuation of the closing mechanism for the gripper pair offers the special advantage that the final or end position of the gripper pair is automatically adjusted to the respective thickness of the paper sheet. If the motor is driven with constant torque, the final or end position for optimal gripping of the sheet is automatically realized.

In the other embodiments of the invention wherein this advantage does not exist, provision is made for storing the gripper end position in accordance with the parameter "paper sheet thickness" in a memory associated with the computer and, depending upon the inputted paper thickness, the computed or experimentally determined gripper end position is selected by the control device.

An advantageous embodiment of the gripper apparatus according to the invention, which is produced especially by selecting, respectively, an individual gripper pair and an individual group of gripper pairs, requires that, as the case may be, only that gripper pair or those gripper pairs be actuated which, depending upon the sheet format, is or are necessary for transporting the sheet.

Thus, in accordance with an additional feature of the invention, an input device is provided for inputting values of parameters selected from the group thereof consisting of sheet-specific and printing press-specific parameters to the computer of the control device, the gripper pair being actuatable by the control device in accordance with a sheet-width parametric value.

In accordance with yet another feature of the invention, there is provided, in association with the computer, a memory wherein a gripper end position determinable experimentally or by computation is storable in accordance with a sheet-thickness parameter, the gripper end position being controllable by the control device as a function of the sheet thickness parameter. With regard to embodiments of the gripper apparatus according to the invention wherein it is necessary to set the gripper opening in accordance with the paper sheet thickness, provision is made for the control device to set the respectively required gripper opening automatically. It is thereby possible to adjust either the gripper member or, alternatively, the gripper support appropriately.

In accordance with yet a further feature of the invention, the control device serves for randomly controlling the opening of the gripper pair.

In accordance with yet an added feature of the invention, the paper sheet-position sensing device is operatively associated with a respective sheet-conducting cylinder, and the control device is actuatable for controlling opening and closing-time movements, respectively, of the respective gripper member whenever an actual position of a sheet leading or trailing edge deviates from a respective setpoint position thereof. Thus, at least one paper sheet-position sensing device is associated with at least one of the sheet-conducting cylinders. Should the actual position of a sheet edge deviate from a predetermined setpoint position, the control device operates the opening and/or closing movements of the pairs of grippers in a temporally staggered manner. A possibility is thereby afforded, while the paper sheet is being transported through the printing press, for the sheet to be displaced in or opposite to the direction of sheet transport, so that the optimal positioning of the sheet in the pairs of grippers of the impression cylinders is always assured.

In accordance with a concomitant feature of the invention, the paper sheet-position sensing device is operatively associated with a respective sheet-conducting cylinder and serves for monitoring edges of a sheet conducted thereby, and the control device is actuatable for controlling the gripper pair so as to compensate for a skew position of a sheet whenever a sheet in skew position is detected on a sheet-conducting cylinder. Thus, at least one paper sheet-position sensing device monitors the sheet edges and, should a skew position of a sheet be detected on a sheet-conducting cylinder, the control device appropriately controls the gripper pairs associated with a sheet-conducting cylinder, so that the skew position of the sheet is compensated for, to a very great extent. In particular, the paper sheet-position sensing device includes an illuminating device and a receiving device, the latter being, for example, a row of CCDs. Such paper sheet-position sensing devices, respectively, are associated with a sheet-conducting cylinder and detect the side edges or the leading or trailing edges of the sheets traveling through the printing press. From deviations of the actual position of the sheet edges from a predetermined setpoint position, the skew position of the sheet is able to be determined with desired accuracy. Compensation can be afforded for the skew position of the sheet on the cylinder by the computer-controlled opening of the gripper pairs of a gripper bridge, at staggered or offset instants of time.

Other features which are considered as characteristic for the invention are set forth in the appended claims.

Although the invention is illustrated and described herein as embodied in a gripper apparatus on sheet-processing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
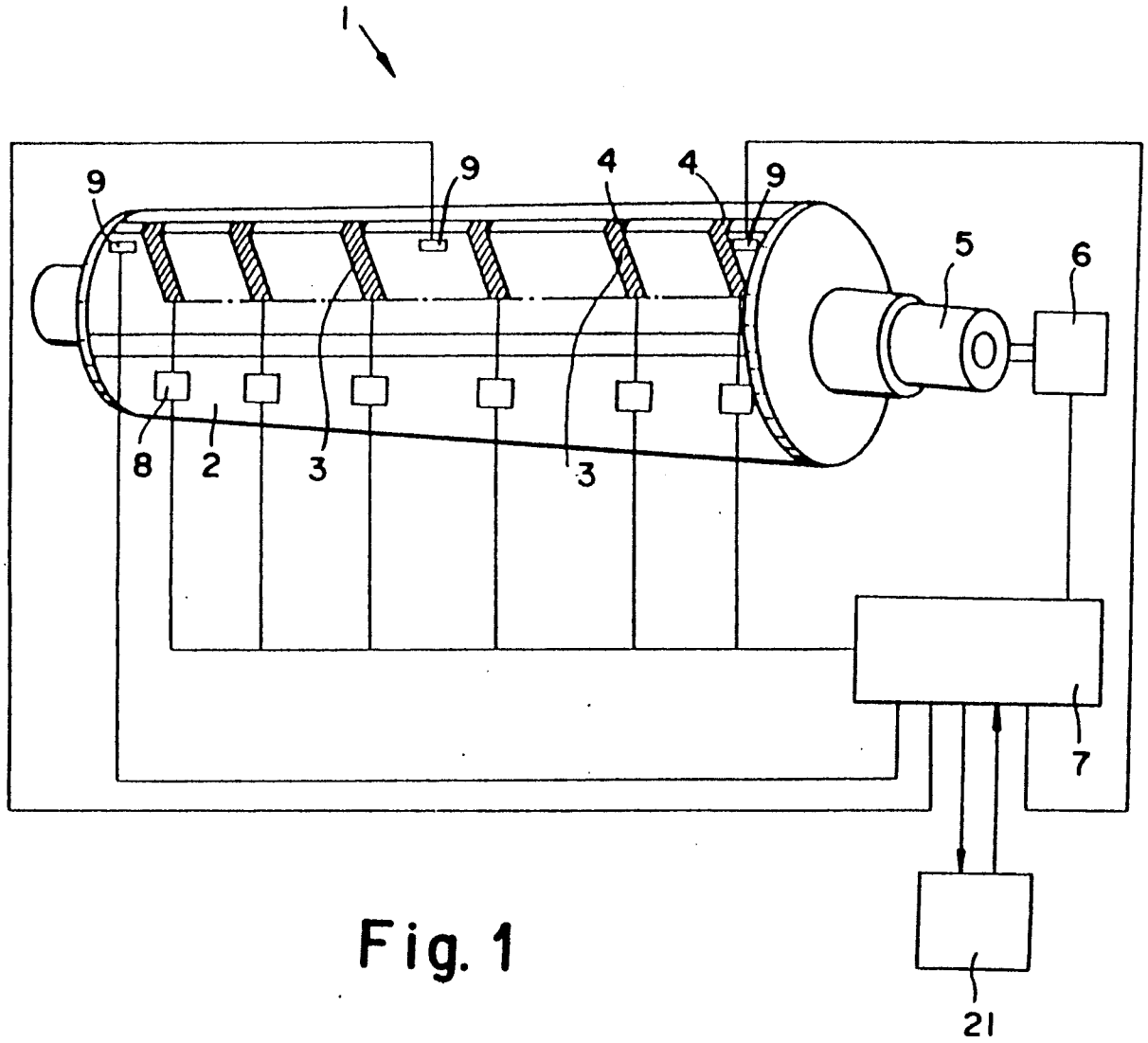
FIG. 1 is a diagrammatic and schematic representation of the gripper apparatus according to the invention on a sheet-fed printing press, of which only a sheet transfer cylinder is shown.

Referring now to the figures of the drawing and, first, particularly to FIG. 1 thereof, there is shown therein, in a diagrammatic and schematic view, a gripper apparatus 1 according to the invention, in association with a sheet-conducting or transfer cylinder 2 of an otherwise non-illustrated sheet-fed printing press. The gripper apparatus 1 includes a plurality of gripper pairs 3,4, respectively, made up of a movable gripper member 3 and a fixed gripper seat or support 4, the latter being carried by a bar extending across the cylinder 2, as shown in FIG. 1. An essential feature of the gripper apparatus 1 according to the invention is that each movable gripper member 3 thereof and each rather small group of the gripper members 3, respectively, are controlled by a suitable number of opening-and-closing mechanisms 8. In order to ensure that the opening-and-closing mechanism 8 is operative at the instant of time at which sheet transfer, i.e., sheet surrender and sheet takeover, respectively, is to occur, an angle sensor 6 is provided in association with the shaft 5 of the sheet-conducting or guiding cylinder 2 and furnishes information regarding the respective angular position to a computer 7. The angular information supplied to the computer 7 is utilized thereby for operating the opening-and-closing mechanism 8 at predetermined angular positions, so that optimal transport of the sheets through the printing press is assured. The angular sensor 6 is a rotary encoder or angular transducer of conventional construction, especially of the incremental type, such as is described, for example, in the article "Incremental Angular Sensors for Determining Motion" in Der Elektroniker May 1984, pages 40 to 43.

In accordance with further advantageous developments of the invention, provision is made for the gripper apparatus to detect the position of the paper sheet on the sheet-conducting cylinder 2. For this purpose, at least one sheet-position detection sensor 9 is disposed in a lateral region of the edges of the sheet. Instead of the angle sensor 6, the sheet-position detection sensors 9 provide information regarding the angular position at which the opening and/or closing mechanism 8 must be operated; furthermore, the sheet-position detection sensors 9 permit the detection of a sheet in a skew position on the sheet-conducting cylinder 2. By actuating the gripper members 3 at staggered instants of time, the differences therebetween being calculated by the computer 7, it is possible to compensate readily for a skew position of a sheet. To permit the sheet-position detection sensors 9 to be set to the respective sheet format, they are displaceably disposed on a suitable crosstie rod or traverse.

In addition to the two sheet-position detection sensors 9 in the lateral region of the sheet edges, another sheet-position detection sensor 9 is disposed in the region between the two lateral sheet-position detection sensors 9. This additional, more-or-less centrally disposed, sheet-position detection sensor 9 serves for detecting a convex or concave displacement of the sheet on the sheet-conducting cylinder 2. By means of the computer-controlled operation of the gripper pairs 2,3, it is possible also to compensate for such a displacement of the sheet.

An input device 21 is further provided for inputting values of parameters, which are specific to the respective paper sheet and to the printing machine, into the computer 7 which, with the opening and/or closing mechanism 8, the angle sensor 6 and/or the sheet-position detection sensors 9 form a control device which is thus able to activate respective gripper pairs 3,4 in accordance with or as a function of a sheet-width parametric value. Accordingly, depending upon the sheet format, an individual gripper pair 3,4 or an individual group of gripper pairs 3,4, respectively, may be selected for activation by the control device, only if it is or they are necessary for transporting the sheet. The input device 21 is of a conventional type, such as has become known from the European Published Patent Application 0 243 661 A1 which was published on Nov. 11, 1987.

Figure 2:
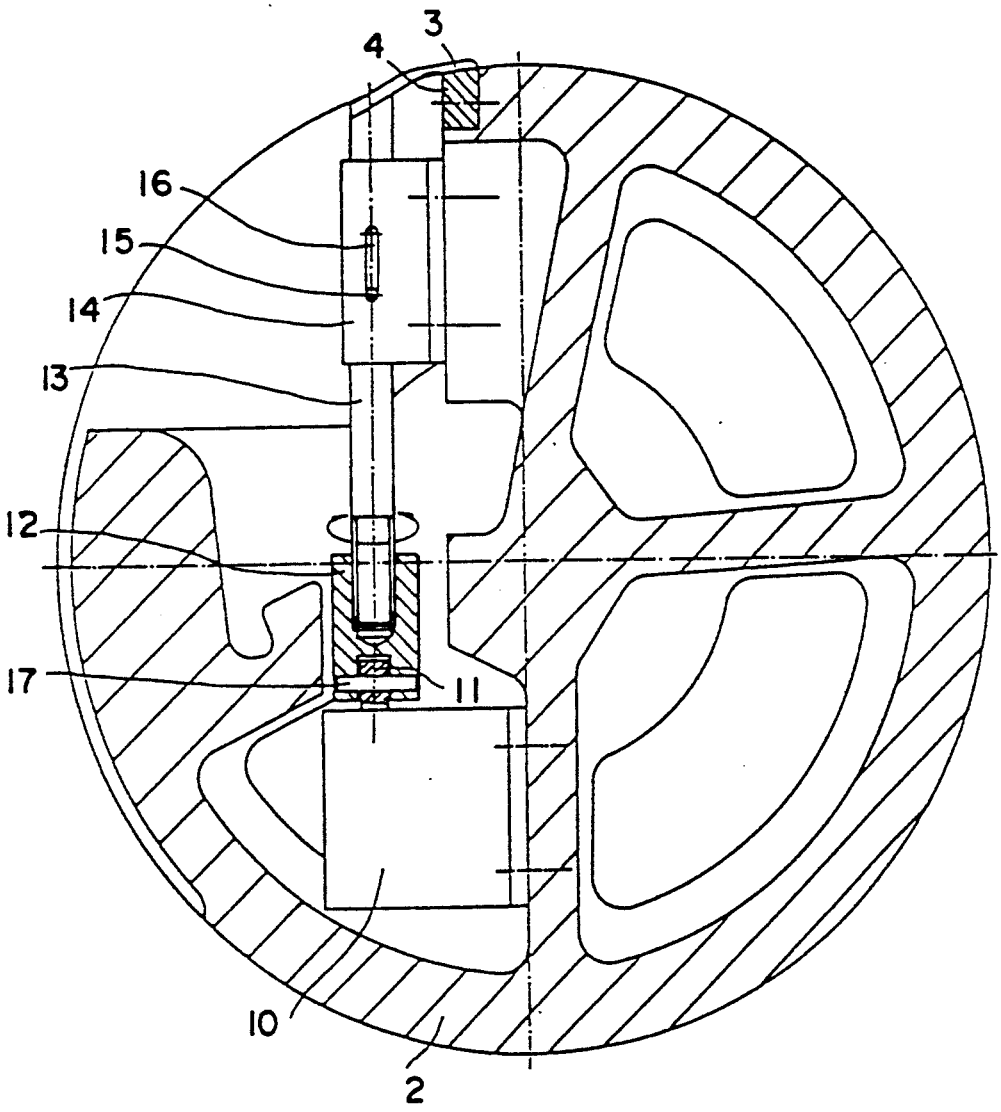
FIG. 2 is an enlarged cross-sectional view of the sheet transfer cylinder of FIG. 1 within which there is shown incorporated a first embodiment of a motor-controlled gripper apparatus according to the invention.

FIG. 2 illustrates a first embodiment of the gripper apparatus according to the invention, wherein the opening and closing of the gripper pairs 3,4, respectively, are controlled by a motor 10. Usually, each gripper member 3 is associated with a separate motor 10; in a special embodiment, however, it is also possible to provide for one motor 10 to drive a plurality of the gripper members 3 simultaneously. This is particularly advantageous when the gripper members 3 are disposed in the central region of the sheet-carrying cylinder 2.

As mentioned hereinbefore, the opening and closing of the gripper pair 3,4 is effected by a motor 10, which is disposed inside the sheet-carrying cylinder 2. A sleeve 12 formed with an internal or female thread is disposed on the output shaft 11 of the motor 10. The sleeve 12 is attached to the output shaft 11 by means of a pin 17. A carrier rod 13 has an externally threaded lower end, as viewed in FIG. 2, by which it is screwed into the female thread of the sleeve 12, and an upper end to which the gripper member 3 is rigidly attached. The carrier rod 13 is guided by a guide sleeve 14 and is secured against turning relative to the sleeve 14 by means of a pin 15, which moves in an oblong hole or slot 16 formed in the sleeve 14. The gripper pair 3,4 is opened and closed, respectively, depending upon the rotational movement of the motor 10.

For the aforedescribed motor-controlled operation of the gripper member 3, it is unnecessary to adjust or set the gripper end position to the respective paper thickness. If the motor is operating at constant torque, the gripper end position is reached automatically when a change in the torque occurs. Assurance is thereby provided that, regardless of the respective paper thickness, reliable gripping of the sheet occurs without any paper damage due to excessive compression in the vicinity of the sheet edges.

As described hereinbefore with regard to FIG. 1, the motor is computer-controlled in accordance with or as a function of the respective angular position of the printing press or of the sheet-guiding cylinder 2.

Figure 3:
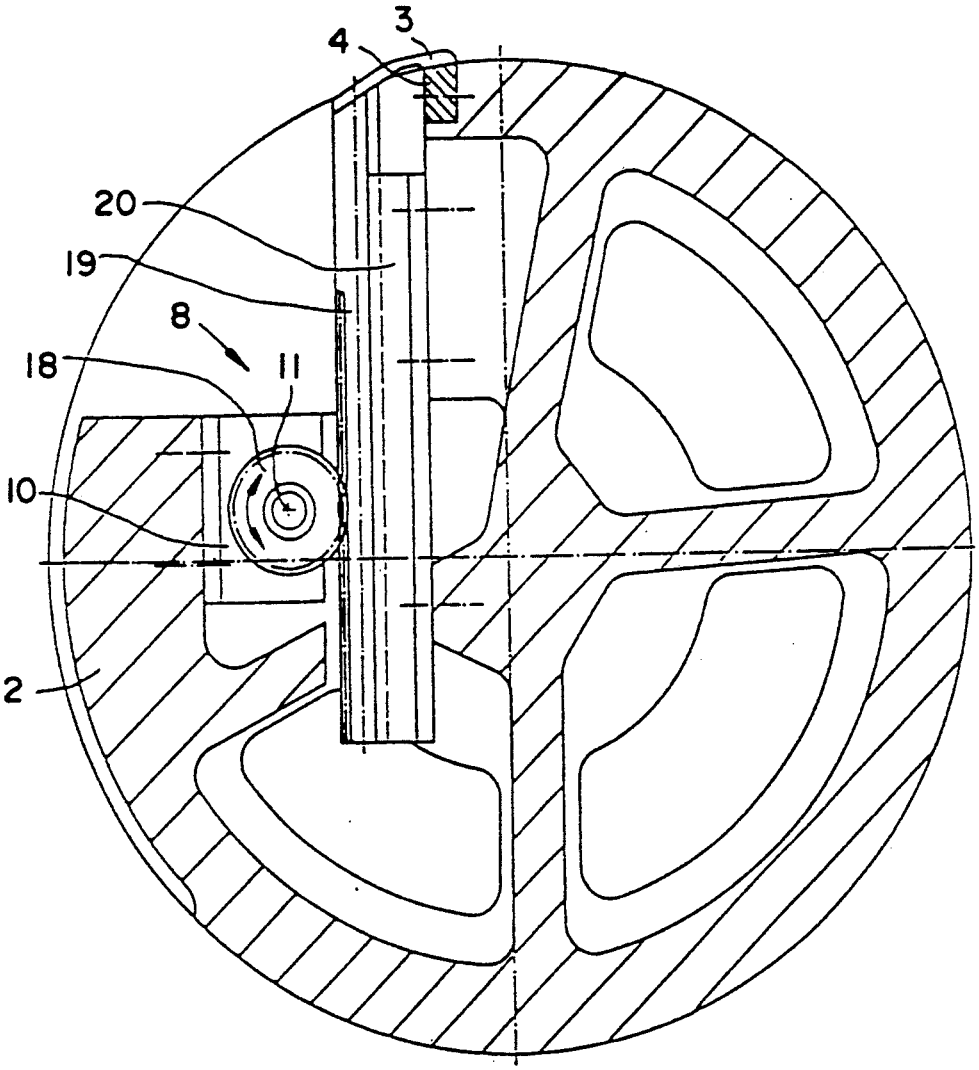
FIG. 3 is a view like that of FIG. 2 showing therein a second embodiment of the motor-controlled gripper apparatus according to the invention.

FIG. 3 represents another embodiment of the gripper apparatus 1 according to the invention. In this embodiment, also, the gripper member 3 is controlled through the intermediary of a motor 10. A spur gear 18 is mounted on an output shaft 11 of the motor 10 and engages with a toothed rack 19, which is guided by a guide rail 20. The gripper member 3 is rigidly attached to the toothed rack 19 at an upper end thereof, as viewed in FIG. 3. The gripper pair 3,4 is opened or closed, depending upon the direction of rotation of the motor 10. In this embodiment, also, the end position of the gripper member 3 is adapted or set automatically to the respective paper or sheet thickness.

Figure 4:
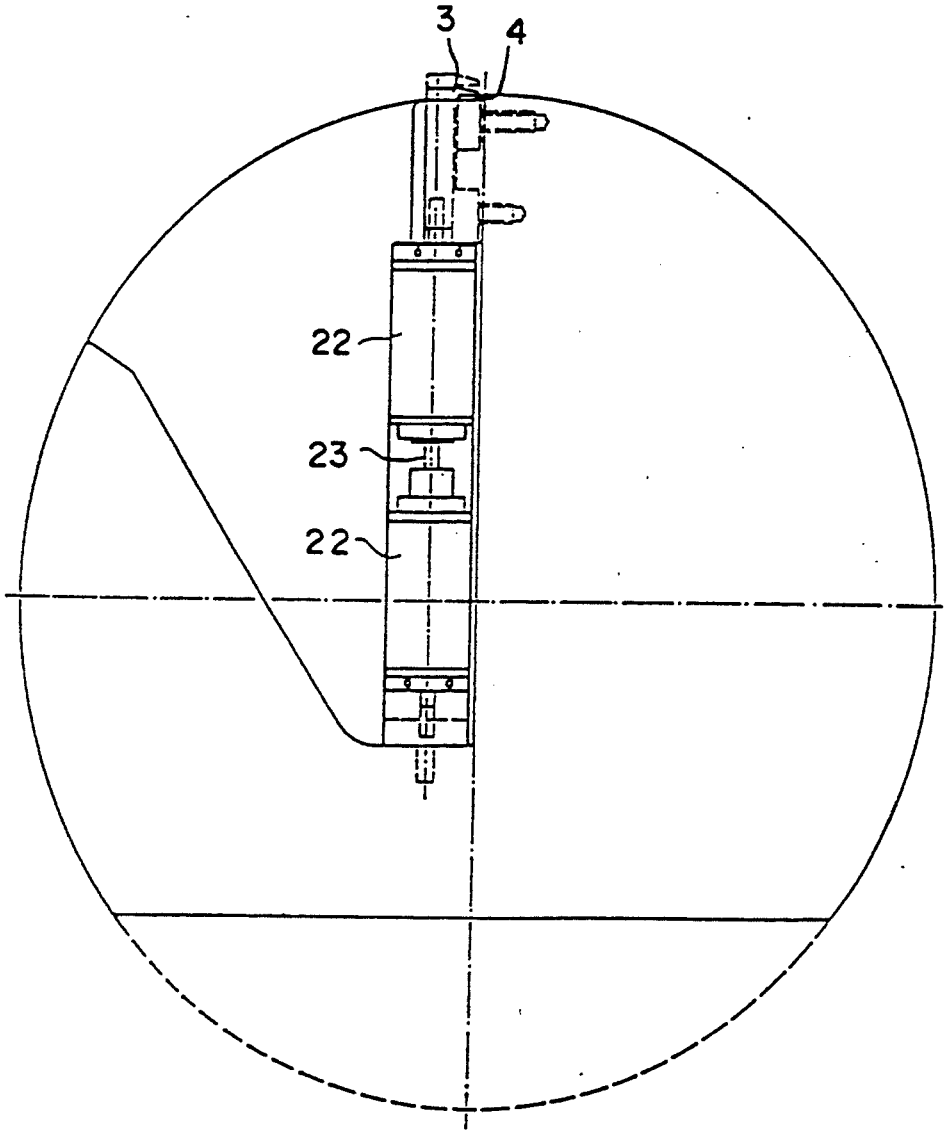
FIG. 4 is a view of a third embodiment of the inventive gripper apparatus, which is electromagnetically operated.

FIG. 4 shows a third embodiment of the gripper apparatus 1 according to the invention, wherein the opening and closing, respectively, of the gripper pair 3,4 is effected through the intermediary of two electromagnets 22. Disposed coaxially with respect to the electromagnets 22 is an armature in the form of a bolt 23 having an upper end, as viewed in FIG. 4, to which the gripper member 3 is rigidly attached. The two electromagnets 22 operate in opposite directions, so that, when one of them is energized, the gripper pair 3,4 is opened and, when the other is energized, the gripper pair 3,4 is closed by the gripper member 3 being pressed against the gripper seat or support 4. It is, of course, also possible for only the gripper opening action to be effected by an electromagnet 22, while the gripper closing action is performed by a spring, or for only the gripper closing action to be effected by an electromagnet 22, while the gripper opening action is performed by a spring. To ensure, at least, that the gripper 3 will be opened, for example, in the event of the failure of one of the electromagnets 22, the spring should be attached to the lower end of the bolt 23, as viewed in FIG. 4 so that the gripper 3 is forced away from the gripper support 4.

This last-mentioned embodiment of the invention, wherein electromagnetically operated gripper movements are performed, offers the advantage that it also operates sufficiently fast even at very high press speeds. By suitably energizing the electromagnets 22, it is possible to adjust or set the gripper opening and the gripper end position in accordance with the paper thickness. If the paper thickness is known, it is possible, for example, for the computer 7 to access stored characteristic data or for this characteristic data to be computed as a function of the respective paper thickness.

In addition to the hereinaforedescribed embodiments, wherein gripper movement is effected by a motor or an electromagnet, it is also possible for the gripper movement to be controlled hydraulically or pneumatically, possibly also in conjunction with springs. Any desired combinations of the individual types of control are also possible.

Figure 5:
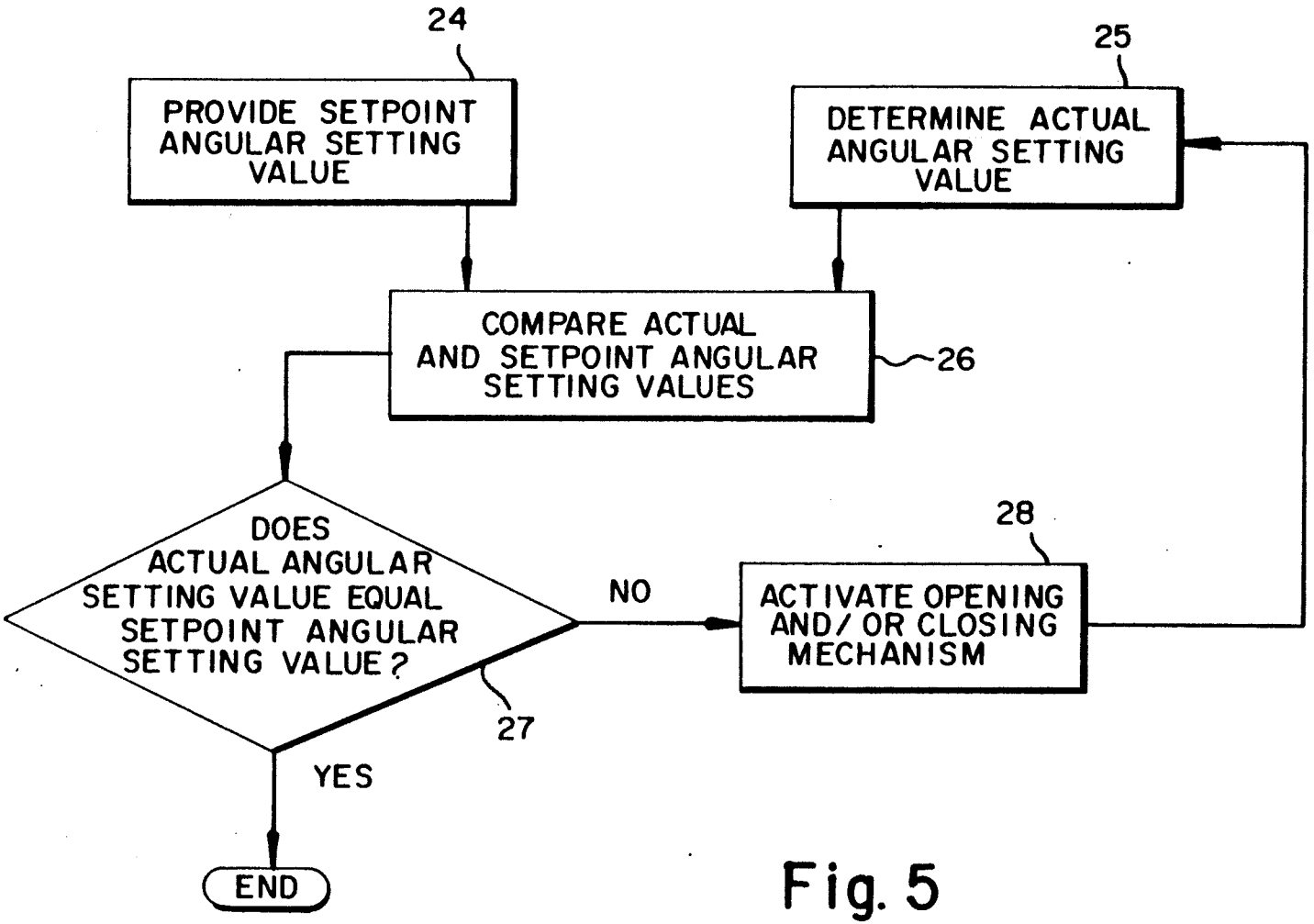
FIG. 5 is a flow chart depicting the operation of a control device of the gripper apparatus according to the invention.

The operation of the the control device of the gripper apparatus 1 is represented in the flow chart of FIG. 5, wherein, at 24, a setpoint angular setting value is provided, for example, in a memory of the computer 7, and an actual angular setting value is determined at 25 by the angle sensor 6. The provided setpoint angular setting value and the determined or measured actual angular setting value are compared in the computer 7. If, as shown at 27, the actual angular setting value is equal to the setpoint angular setting value, the operation is completed; however, if the actual angular setting value is not equal to the setpoint angular setting value, at 28, the respective opening and/or closing mechanisms are activated, and a new actual angular setting value is measured or determined at 25, and the operation is repeated to its end.

We claim:

1. Gripper apparatus on a sheet-processing machine, comprising a pair of cooperative gripper members, a control device including a computer for controlling said pair of gripper members, at least one data transmitter connected to said computer for inputting data therein, and means for performing at least one function selected from a group thereof consisting of opening and closing said pair of gripper members in response to an output of said computer, said function-performing means being operatable at predetermined positions of the sheet-processing machine, an input device for inputting values of parameters selected from the group thereof consisting of sheet-specific and printing press-specific parameters to said computer of said control device, said pair of gripper members being actuatable by said control device in accordance with a sheet-width parametric value.

2. Gripper apparatus according to claim 1, wherein said data transmitter is an angle-of-rotation transmitter.

3. Gripper apparatus according to claim 1, wherein said data transmitter is a sensing device for detecting the position of a paper sheet.

4. Gripper apparatus according to claim 1, wherein said function-performing means comprise an electromagnet.

5. Gripper apparatus according to claim 1, wherein said function-performing means comprise an opening mechanism formed as a spring, and a closing mechanism formed as an electromagnet.

6. Gripper apparatus according to claim 1, wherein said function-performing means comprises an opening mechanism formed as an electromagnet, and a closing mechanism formed as a spring.

7. Gripper apparatus according to claim 1, wherein said control device includes means for hydraulically controlling said mechanism for respectively opening and closing said pair of gripper members.

8. Gripper apparatus according to claim 1, wherein said control device includes means for pneumatically controlling said mechanism for respectively opening and closing said pair of gripper members.

9. Gripper apparatus according to claim 1, wherein said control device serves for randomly controlling the opening of said pair of gripper members.

10. Gripper apparatus according to claim 3, wherein said paper sheet-position sensing device is operatively associated with a respective sheet-conducting cylinder, and said control device is actuatable for controlling opening and closing-time movements, respectively, of said pair of gripper members whenever an actual position of a sheet leading or trailing edge deviates from a respective setpoint position thereof.

11. Gripper apparatus according to claim 3, wherein said paper sheet-position sensing device is operatively associated with a respective sheet-conducting cylinder and serves for monitoring edges of a sheet conducted thereby, and said control device is actuatable for controlling said pair of gripper members so as to compensate for a skew position of a sheet whenever a sheet in skew position is detected on a sheet-conducting cylinder.

12. Gripper apparatus on a sheet-processing machine, comprising a pair of cooperative gripper members, a control device including a computer for controlling said pair of gripper members, at least one data transmitter connected to said computer for inputting data therein, means for performing at least one function selected from a group thereof consisting of opening and closing said pair of gripper members in response to an output of said computer, said function-performing means being operatable at predetermined positions of the sheet-processing machine, a motor for operating said function-performing means, said motor having an output shaft, a sleeve secured to said output shaft and formed with an internal thread, and a carrier rod rigidly connected to one gripper member of said pair of gripper members and formed with an external thread engaging with said internal thread of said sleeve so that, depending upon the direction of rotation of said motor, said pair of grippers is opened or closed.

13. Gripper apparatus according to claim 12, including a guide sleeve guidingly engaging said carrier rod, said guide sleeve being formed with a slot, and said carrier rod having a pin extending therefrom and engaging in said slot so as to secure said carrier rod against turning relative to said sleeve.

14. Gripper apparatus on a sheet-processing machine, comprising a pair of cooperative gripper members, a control device including a computer for controlling said pair of gripper members, at least one data transmitter connected to said computer for inputting data therein, means for performing at least. one function selected from a group thereof consisting of opening and closing said pair of gripper members in response to an output of said computer, said function-performing means being operatable at predetermined positions of the sheet-processing machine, a motor for operating said function-performing means, said motor having an output shaft, a spur gear carried by said output shaft, a toothed rack rigidly connected to one gripper member of said pair of gripper members, said spur gear meshingly engaging with said toothed rack so that said pair of gripper members opens and closes, respectively, in accordance with the direction of rotation of the motor.

15. Gripper apparatus on a sheet-processing machine, comprising a pair of cooperative gripper members, a control device including a computer for controlling said pair of gripper members, at least one data transmitter connected to said computer for inputting data therein, means for performing at least one function selected from a group thereof consisting of opening and closing said pair of gripper members in response to an output of said computer, said function-performing means being operatable at predetermined positions of the sheet-processing machine, a memory associated with said computer and having a gripper end position determinable experimentally or by computation storable in accordance with a sheet-thickness parameter, said griper end position being controllable by said control device as a function of said sheet thickness parameter.

* * * * *